US009067262B1

(12) United States Patent
Deinzer

(10) Patent No.: US 9,067,262 B1
(45) Date of Patent: Jun. 30, 2015

(54) COPPER ALLOY PARTICLE SYNTHESIS

(71) Applicant: Joshua M. Deinzer, Hamburg, NY (US)

(72) Inventor: Joshua M. Deinzer, Hamburg, NY (US)

(73) Assignee: ENERGETIC MATERIALS LLC, Amherst, NY (US)

( * ) Notice: Subject to any disclaimer, the term of this patent is extended or adjusted under 35 U.S.C. 154(b) by 288 days.

(21) Appl. No.: 13/681,053

(22) Filed: Nov. 19, 2012

Related U.S. Application Data

(62) Division of application No. 12/725,876, filed on Mar. 17, 2010, now Pat. No. 8,313,551.

(51) Int. Cl.

| | |
|---|---|
| ***C22C 9/00*** | (2006.01) |
| ***C22C 9/06*** | (2006.01) |
| ***B22F 9/16*** | (2006.01) |

(52) U.S. Cl.
CPC ... *B22F 9/16* (2013.01); *C22C 9/06* (2013.01); *C22C 9/00* (2013.01)

(58) Field of Classification Search
None
See application file for complete search history.

(56) References Cited

U.S. PATENT DOCUMENTS

| | | | | |
|---|---|---|---|---|
| 6,585,796 | B2 * | 7/2003 | Hosokura et al. | 75/373 |
| 6,679,937 | B1 * | 1/2004 | Kodas et al. | 75/365 |
| 7,066,980 | B2 * | 6/2006 | Akimoto et al. | 75/351 |
| 7,459,007 | B2 | 12/2008 | Goia et al. | |
| 2006/0090600 | A1 | 5/2006 | Goia et al. | |
| 2006/0179975 | A1 * | 8/2006 | Yamashina et al. | 75/255 |

* cited by examiner

*Primary Examiner* — George Wyszomierski
(74) *Attorney, Agent, or Firm* — Del Vecchio and Stadler LLP

(57) ABSTRACT

The present invention provides a novel process for synthesis of a copper-alloy particle with improved grain boundary properties. The process comprises the steps of: forming a solution from an alcoholic agent and a branched dispersing agent; forming a reaction mixture with the solution and a copper precursor and optionally a nickel precursor; heating the reaction mixture; cooling the reaction mixture; adding an additional amount of copper precursor and at least one precursor selected from the group consisting of: nickel, zinc, and bismuth; heating the reaction mixture; and maintaining the reaction mixture for a time sufficient to reduce the reaction mixture to copper-alloy particles.

6 Claims, 1 Drawing Sheet

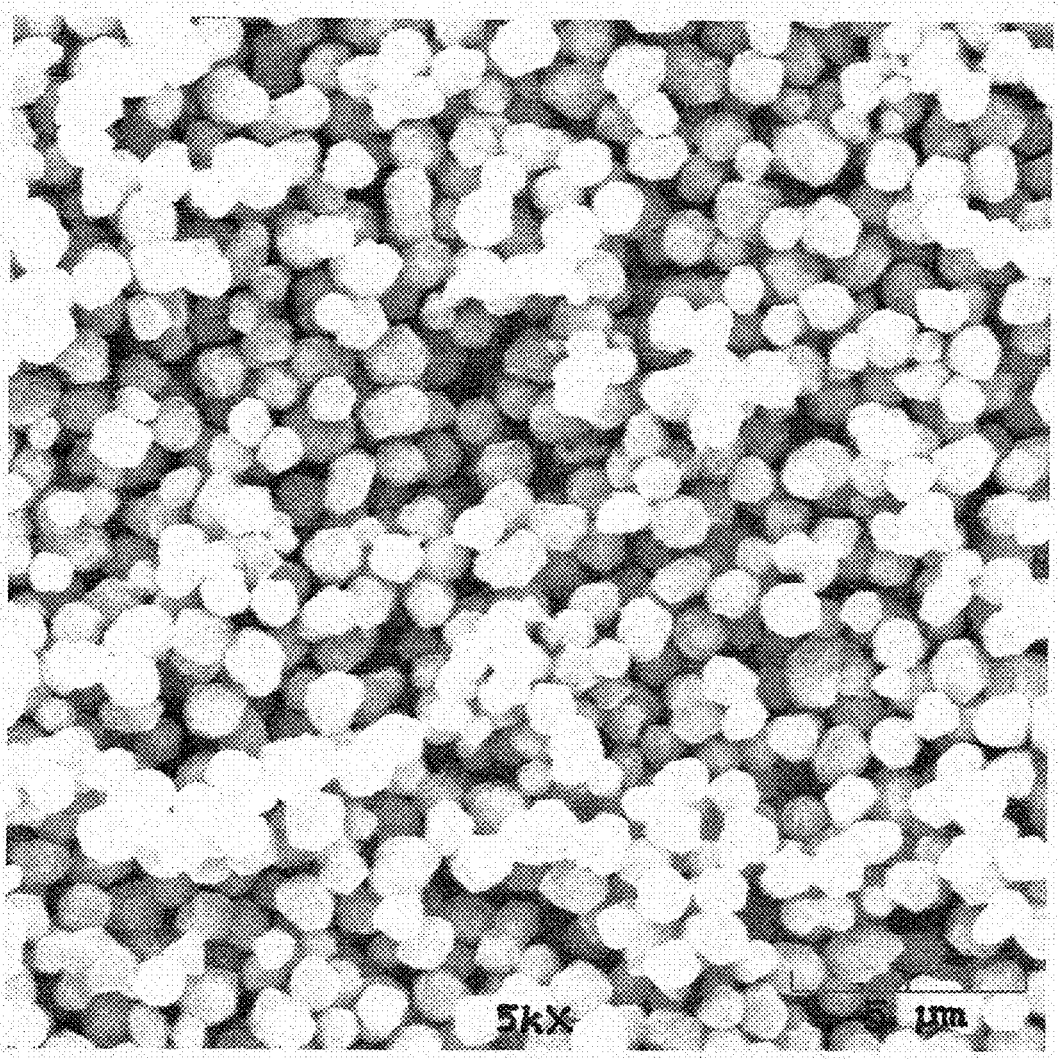
5kX
1μm

COPPER ALLOY PARTICLE SYNTHESIS

CROSS-REFERENCE TO RELATED APPLICATIONS

This application is a divisional of pending U.S. Nonprovisional application Ser. No. 12/725,876, filed Mar. 17, 2012, the disclosure of which is incorporated herein by reference.

FIELD OF INVENTION

This invention is directed to a process for synthesis of a copper-alloy particle with improved grain boundary properties.

BACKGROUND OF INVENTION

Conventionally, copper particles are prepared by atomization, electrolysis, hydrometallurgy, or solid state reduction processes.

Briefly, atomization includes the steps of melting copper until it is a liquid and flowing the liquid copper through an orifice where it is struck by a high velocity stream of gas or liquid. Typically, this stream is water. The (water) stream breaks the molten metal into particles that then rapidly solidify. In this process, several factors influence the particle size and shape, including: the atomizing medium, the pressure, and the flow rate.

Electrolysis can be used to produce electrolytic copper powder. This process follows the same principles that are used in electroplating, but the conditions are changed to produce a loose powder deposit rather than a smooth solid layer. These conditions include: a low copper ion concentration in the electrolyte, high acid concentration, and high cathode current density. The properties of the copper particle vary depending on, among other variables, the temperature and current density.

In the hydrometallurgy process, copper is leached from cement copper, the solution is then filtered, thus producing copper powder particles. The properties of the copper particles depend on temperature and other process variables.

In the solid state reduction method, copper oxides are ground to a predetermined or desired particle size and then reduced by a gas at a temperature that is below the melting point of copper. The particle size and shape depends on the particle size and shape of the copper oxide, the temperature, the pressure, and the flow rate of the gas.

The above processes all have significant limitations including: too large of a range of particle size distribution, lack of a uniform grain size, and do not have the purity levels required by some applications.

SUMMARY OF THE INVENTION

Accordingly, it is the subject of this invention to provide a process that produces a better copper-alloy particle with improved particle size distribution, grain size, and purity. In one of the preferred embodiments, the copper-alloy particles may be synthesized in accordance with a process that includes the steps of:

(a) forming a solution from an alcoholic agent and a branched dispersing agent;
(b) optionally stirring the solution;
(c) optionally heating the solution up to 170° C. or less;
(d) adding a copper precursor and optionally a nickel precursor to the solution to form a reaction mixture;

(e) heating the reaction mixture to a temperature in the range of 170° C. to 190° C.;
(f) cooling the reaction mixture to below 170° C.;
(g) adding an additional amount of copper precursor and at least one precursor selected from the group consisting of: nickel, zinc, and bismuth;
(h) heating the reaction mixture to a temperature in the range of 170° C. to 190° C.; and
(i) maintaining the reaction mixture at a temperature in the range of 170° C. to 190° C. for a time sufficient to reduce the reaction mixture to copper-alloy particles.

BRIEF DESCRIPTION OF THE DRAWINGS

FIG. 1 depicts a Scanning Electron Microscopic image of copper-alloy particles synthesized by a process of the present invention.

DETAILED DESCRIPTION OF THE INVENTION

As used herein and in the appended claims, the singular forms "a," "an," and "the" include plural references unless the content clearly dictates otherwise. Thus, for example, reference to "a particle" includes a plurality of such particles, and reference to "the polyol" is a reference to one or more polyols and equivalents thereof known to those skilled in the art, and so forth. The disclosures of all of the publications, patent applications, patents, and other references mentioned herein are incorporated by reference in their entirety.

The term "alloy" as used herein and in the appended claims includes a mixture of two metals. The term "mixture" as used herein and in the appended claims includes two metals mixed together, but not necessarily in fixed proportions, and not necessarily with chemical bonding. That is, as long as both metals are present, it is a mixture.

One way to measure whether something is a mixture is to use an electron dispersion spectroscope. Electron dispersion spectroscopes are commercially available and their construction and use are well known to those having ordinary skill in the art and are therefore not further described herein.

In the case of the copper-alloys produced by one embodiment of the present invention to be described presently, a 2.0 μm sphere has a 1.8 μm core of large grain copper metal coated with a 0.2 μm shell of nickel. At the metallic interface, metals will slowly solvate into each other creating an alloy. The copper-alloy powders can be milled into flakes, greatly increasing the interface between the two metals. Coupled with the solubility of the metals, the resulting flake is a homogenous alloy of copper and nickel at all points through the copper-alloy.

In one of the preferred embodiments, the present invention provides a method of synthesizing copper-alloy particles comprising the steps of:

(a) forming a solution from an alcoholic agent and a branched dispersing agent;
(b) optionally stirring the solution;
(c) optionally heating the solution up to 170° C. or less;
(d) adding a copper precursor and optionally a nickel precursor to the solution to form a reaction mixture;
(e) heating the reaction mixture to a temperature in the range of 170° C. to 190° C.;
(f) cooling the reaction mixture to below 170° C.;
(g) adding an additional amount of copper precursor and at least one precursor selected from the group consisting of: nickel, zinc, and bismuth;
(h) heating the reaction mixture to a temperature in the range of 170° C. to 190° C.; and (i) maintaining the reaction mixture at a temperature in the range of 170° C. to 190° C. for a time sufficient to reduce the reaction mixture to copper-alloy particles.

The term "branched dispersing agent" as used herein and in the appended claims includes any dispersing agents, which have at least one side group that includes at least one carbon, such as a branched polyol. The term "branched polyol" as used herein and in the appended claims includes polyols, which have at least one side group that includes at least one carbon. Branched polyols suitable for the process of the present invention include, without limitation, 2-C-methylerythritol, 2-C-methylreitol, and pentaerythritol ("PE"). Branched polyols may have a number of roles in the reaction mixture, including functioning as a dispersant and/or reducing agent. The term "reducing agent" as used herein and in the appended claims generally includes any agent which is capable of reducing a precursor of a metal to elemental metals and/or metal particles.

The term "alcoholic agent" as used herein and in the appended claims includes a polyol. The polyol composition used in the process of the present invention may be controlled by the particular reaction. The polyol is either an aliphatic glycol, or a corresponding glycol polyester. There are a broad range of polyols, of particular interest: ethylene glycol, triethylene glycol, tetra-ethylene glycol, propanediol-1,2, dipropylene glycol, butanediol-1,2, butanediol-1,3, butanediol-1,4, and butanediol-2,3. The polyols may be in liquid form. In one of the preferred embodiments, 1,2-propylene glycol ("1,2-PG"), 1,3-propylene glycol (1,3-PG), diethyleneglycol ("DEG"), or combinations thereof, may be used in the reaction mixture. In another preferred embodiment, a mixture of 1,2-PG and DEG may be used as the reducing polyol.

In one of the preferred embodiments of the present invention, the branched dispersing agent is dissolved into the alcoholic agent.

In another aspect, the amount of the branched dispersing agent in the solution is less than or equal to 5 weight percentage (hereinafter referred to as "wt %").

In yet another aspect of the present invention, the copper precursor of step d is present in an amount of 25-35 wt % relative to the total weight of the solution, copper precursor of step d, and optional nickel precursor of step d.

In a preferred embodiment of the present invention, the copper precursor is copper carbonate and the nickel precursor is nickel carbonate.

In yet another aspect, the nickel precursor of step d is present in an amount of 0-10 wt % relative to the total weight of the solution, copper precursor of step d, and optional nickel precursor of step d.

In a further aspect of the present invention, the solution is present in an amount of 65-75 wt % relative to the total weight of the solution, copper precursor of step d, and optional nickel precursor of step d.

In yet another aspect, the additional amount of copper precursor of step g and the at least one precursor of step g are present in an amount of 10-30 wt % relative to the amount of the copper carbonate and the optional nickel carbonate of step d.

In another aspect of the present invention, the additional amount of copper precursor of step g is present in an amount of 5-25 wt % relative to the amount of the copper carbonate and the optional nickel carbonate of step d.

In another preferred embodiment of the present invention, the zinc precursor is zinc carbonate and the bismuth precursor is bismuth carbonate.

In another aspect of the invention, the method further includes the steps of:

cooling the copper-alloy particles;

washing the copper-alloy particles with water and/or a solvent; and, milling the copper-alloy particles into copper-alloy flakes.

In another preferred embodiment, the present invention provides a method of synthesizing copper-alloy particles comprising the steps of:

(a) forming a solution from an alcoholic agent and a branched dispersing agent;
(b) optionally stirring the solution;
(c) optionally heating the solution up to 170° C. or less;
(d) adding a copper precursor and a nickel precursor to the reaction mixture;
(e) heating the reaction mixture to a temperature in the range of 170° C. to 190° C.;
(f) cooling the reaction mixture to below 170° C.;
(g) adding an additional amount of copper precursor and nickel precursor to the solution to form a reaction mixture;
(h) heating the reaction mixture to a temperature in the range of 170° C. to 190° C.; and
(i) maintaining the reaction mixture at a temperature in the range of 170° C. to 190° C. for a time sufficient to reduce the copper precursor and the nickel precursor to copper-alloy particles.

Copper Particle Characterization

Copper powder formed by reducing copper carbonate (and optionally nickel carbonate) in propylene glycol has the following properties:

Particle size distribution: $D_{10}$=0.6-1.5 μm
$D_{50}$=1.8-3.0 μm
$D_{90}$=3.0-5.5 μm
Leco Furnace: Total Oxygen=0.008-0.015 wt %
Total Carbon=0.008-0.020 wt %
Tap Density (Apparent Density): 1.5-2.5 g/cm$^3$
Particle Size (as given by Scanning Electron Microscope): $D_{50}$=1.6-2.5 μm
Grain Size Analysis (as given by x-ray diffraction): Particles have a grain size that is two times the industrial standard.

FIG. 1 is a scanning electron microscope (SEM) image of the copper-alloy particles synthesized by a process of the present invention. The SEM shows the copper-alloy particles at a 5× magnification. As shown in FIG. 1, the copper-alloy particles are uniform.

Some of the Advantages of the Present Invention

The process of the present invention utilizes two different equilibriums. First, the process brings the reaction mixture to an upper equilibrium temperature range, then after cooling, the reaction mixture is brought to a lower equilibrium temperature range. Without intending to be bound by theory, it is believed that the upper equilibrium quickly produces nucleation sites and creates smaller grains. Then at the lower equilibrium, the process produces larger grains.

A plurality of unexpected advantages result from this process. For example, the process produces copper-alloy particles that have a tighter particle size distribution over the prior methods. The $D_{10}$ of these particles is 0.75 μm, the $D_{50}$ is 2.0 μm, and the $D_{90}$ is 3.5 μm. This is a much smaller particle size distribution range as compared to the particle size distribution range produced by the past methods.

Another advantage of the present invention is that the overall process unexpectedly has better reproducibility. After running the process of the present invention over one hundred times, there is little to no variation. To contrast, the past methods have a variation of results of about + or −40%.

The process of the present invention also has a better yield per batch than the past methods. The yield of the present invention is 49%. The present invention produces 3.3 kg of copper-alloy particles, whereas the past methods produce 2.7 kg of copper particles.

Additionally, the copper-alloy particles synthesized by the present invention advantageously have a grain size that is two times the grain size of the industrial standard copper particles.

Grain size is calculated from the results of x-ray diffraction using the Debye-Scherrer formula, which is well understood by those of ordinary skill in the art and therefore is not described in detail herein. In comparing the grain size of the particles, copper-alloy particles made by a process of the present invention have grain sizes twice the industrial standard. A larger grain size causes reduced strain in the particles. The reduced strain decreases the stress on the grain boundaries, thereby allowing the particles to be more malleable. This is advantageous in several applications for copper-alloy particles.

There are several additional advantages resulting from the larger grain size of the particles synthesized by the present invention. The particles have less oxygen and often have less organic bi-products. The present invention has an oxygen content of 0.008-0.015 wt % and a carbon (organic) content of 0.008-0.020 wt %, while particles of the prior methods have oxygen contents of 0.024 wt % and carbon contents of 0.015 wt %.

Grain boundaries contain sites for oxidation. Without intending to be bound by theory, it is believed that particles with larger grain boundaries have fewer oxidation sites per particle and thus there is less surface area available for oxygen to oxidize and form oxides. As a result, the present invention has less than one half of the oxygen as particles made from the prior art. This provides a cleaner surface for coating and plating applications.

The process of the present invention also advantageously synthesizes copper-alloy particles that often have lower amounts of organic bi-products as compared to particles made in the past. As is commonly understood, the higher the purity of a metal, the better is its conductivity. That is, the fewer organic bi-products present, the better the conductivity. In an application where the particles are being used for coating with silver, the organic bi-products interfere with the coating. Without intending to be bound by theory, it is believed that the organic bi-products of the propylene glycol are more soluble at the lower equilibrium temperature. Thus, the organic bi-products are more readily washed off of the copper-alloy particles.

Organics inversely result in lowering the oxidation rates of powder exposed to the atmosphere. That is, the more organics the lower the oxidation rate. It is readily apparent that there is a tension between the presence of organics beneficially protecting the particles from oxidation and organics deleteriously decreasing the availability of surface area for silver plating. A high surface area availability is necessary for applications that use silver plating for electrical conductivity. The present invention is advantageous because the copper-alloy particles synthesized have larger grain boundaries, which results in less sites for oxygen to oxidize the surface. The result is that there is no need to increase the presence of organics in order to decrease oxidation because the decrease in oxidation results from the larger grain boundaries without a need to increase the organic content. Thus, the particles synthesized by the present invention are better suited for plating or coating applications.

Another benefit of the present invention is that the copper-alloy particles contain nickel. In applications that use particles synthesized by the process of the present invention, the presence of nickel reduces the di-electric interference of silver coated copper-alloy particles, allowing for a more conductive silver surface.

Without intending to be bound by theory, it is believed that copper-nickel particles are better for silver coating because, in a particle with 10-55 wt % of nickel and the balance copper, some of the nickel will solvate into the copper, creating the alloy constantan. The pure copper will have an interaction, like in a thermocouple, with the constantan converting heat into static electricity. The electric potential resulting from the interaction charges the particle and orientates the silver atoms during the coating process. The result is that there is a more conductive valence layer on the silver surface.

A thermocouple is defined as any junction of dissimilar metals that will produce an electric potential related to temperature. For practical measurement of temperature, thermocouples are junctions of specific alloys which have a predictable and repeatable relationship between temperature and voltage in a circuit. In the absence of a circuit, the electrical potential will be static electricity.

Illustrative Applications

The copper-nickel alloy particles synthesized by a process of the present invention can be used in similar applications to those of the alloy constantan. Constantan is a copper-nickel alloy that typically consists of 55% copper and 45% nickel. Its main feature is its resistivity, which is constant over a wide range of temperatures. Other alloys with similarly low temperature coefficients are known, including manganin ($Cu_{86}Mn_{12}Ni_2$).

The constantan alloy is conventionally made by mixing molten metals. Constantan is used in heating elements because it is the most efficient at transferring electricity to heat. One disadvantage of constantan is that the particles are too big to be used in some micro-electronic applications. The copper-nickel alloy particles synthesized by a process of the present invention are on the micron scale and are thereby suitable for use in printed electronics applications that require particles that conduct electricity. Thus, the copper-nickel alloy particles synthesized by the present process offer the advantages of having similar properties to that of constantan, but being on a micron scale, they are useful in micro-electronic applications.

Another application of the present invention is using the copper-nickel alloy particles as a catalyst, similar to the way in which nickel catalysts are used in U.S. Pat. No. 4,014,819, the disclosure of which is hereby incorporated by reference. Although the copper-nickel alloy particles synthesized by the present invention do not have as high of a surface area as those in the '819 reference, they are less expensive to produce, by about 50%, as compared to those of the '819 patent.

An additional application of the present invention is using the copper-nickel alloy particles in a silver coating process. One such process of silver coating copper particles is disclosed in U.S. Pat. No. 5,178,909, the disclosure of which is hereby incorporated by reference. The silver coated copper-nickel alloy particles can then be used in various electrical applications.

EXAMPLES

Example 1

Copper-Nickel Particle Synthesis

In one of the preferred embodiments of the present invention, 14,730 grams of propylene glycol and 350 grams of pentaerythritol is loaded into a 22 liter flask reactor. The reactor has an agitator. The agitator is spinning at 350 rpms. The reactor heat setting is set to high. After the reaction mixture reaches 60° C., 5,500 grams of copper carbonate is loaded into the reactor along with 500 grams of nickel carbonate.

The reactor is allowed to continue heating until the reactants reach approximately 170° C. While not intending to be bound by theory, it is thought that at this temperature the copper carbonate will reduce to copper metal spheres and then nickel carbonate will reduce on the surface. Again, without intending to be bound by theory, it is thought that the resulting reactants will cause a decrease in temperature due to evaporation of propylene glycol and reactant bi-products.

The reactor continues to heat to 180° C. Once this temperature is reached, the reactor is allowed to cool down to 150° C. Once the reactor temperature reaches 150° C., an additional 1,488 g of nickel carbonate is added to the partially reacted mixture in the reactor and the reactor heater is turned on until the reactor temperature reaches 180° C. The reactor temperature is then maintained at 180° C. for two hours. After two hours, the reactor is turned off and allowed to cool.

The mixture is then removed from the reactor and allowed to settle for 24 hours. Any supernatant is decanted off the copper-alloy sediment. 3.5 liters of distilled water is mixed with the copper-alloy sedimentary layer to dilute and clean the particles of bi-products. This mixture is then allowed to settle for 24 hours.

After 24 hours, the supernatant is decanted and the copper-alloy sedimentary layer is mixed with 2.5 liters of ethanol to solvate any remaining organic impurities. This mixture is then allowed to settle for 24 hours. Again, after 24 hours, the supernatant is decanted. This step is repeated until the supernatant appears to the be the same color as the copper-alloy sedimentary layer.

Once the supernatant is the same color as the copper-alloy sedimentary later, the final supernatant is decanted and the powder copper-alloy sedimentary layer is air dried for 24 hours.

The resulting copper-alloy cake is placed in an inert gas dryer to evaporate any residual ethanol remaining in the copper-alloy cake.

The dried copper-alloy cake is pulverized and sieved in a 100 mesh screen and packaged for shipment. 100 mesh screens are well known to those having ordinary skill in the art and therefore are not further described herein.

Example 2

Copper Particle Synthesis

In another preferred embodiment of the present invention, 14,730 grams of propylene glycol and 350 grams of pentaerythritol is loaded into a 22 liter flask reactor. The reactor has an agitator. The agitator is spinning at 350 rpms. The reactor heat setting is set to high. After the reaction mixture reaches 60° C., 5,500 grams of copper carbonite is loaded into the reactor.

The reactor is allowed to continue heating until the reactants reach approximately 170° C. While not intending to be bound by theory, it is thought that at this temperature the copper carbonate will reduce to copper metal spheres. Again, without intending to be bound by theory, it is thought that the resulting reactants will cause a decrease in temperature due to evaporation of propylene glycol and reactant bi-products.

The reactor continues to heat to 180° C. Once this temperature is reached, the reactor is allowed to cool down to 150° C. Once the reactor temperature reaches 150° C., an additional 1,488 g of copper carbonate is added to the partially reacted mixture in the reactor and the reactor heater is turned on until the reactor temperature reaches 180° C. The reactor temperature is then maintained at 180° C. for two hours. After two hours, the reactor is turned off and allowed to cool.

The mixture is then removed from the reactor and allowed to settle for 24 hours. Any supernatant is decanted off the copper sediment. 3.5 liters of distilled water is mixed with the copper sedimentary layer to dilute and clean the particles of bi-products. This mixture is then allowed to settle for 24 hours.

After 24 hours, the supernatant is decanted and the copper sedimentary layer is mixed with 2.5 liters of ethanol to solvate any remaining organic impurities. This mixture is then allowed to settle for 24 hours. Again, after 24 hours, the supernatant is decanted. This step is repeated until the supernatant appears to the be the same color as the copper sedimentary layer. This color is an orangish-pink.

Once the supernatant is the same color as the copper sedimentary layer, the final supernatant is decanted and the powder copper sedimentary layer is air dried for 24 hours.

The resulting copper cake is placed in an inert gas dryer to evaporate any residual ethanol remaining in the copper cake.

The dried copper cake is pulverized and sieved in a 100 mesh screen and packaged for shipment.

It will be appreciated by those skilled in the art that while the large grain particle synthesis process has been described in detail, the method is not necessarily so limited and other examples, embodiments, uses, modifications, and departures from the embodiments, examples, uses, and modifications may be made without departing from the synthesis process and all such embodiments are intended to be within the scope and spirit of the appended claims.

What is claimed is:

1. A composition of matter, comprising copper-alloy particles, wherein the particles have a $D_{10}$ that is between 0.6-1.5 μm, a $D_{50}$ that is between 1.8-3.0 μm, a $D_{90}$ that is between 3.0-5.5 μm, and an apparent density of 1.5-2.5 g/cm$^3$.

2. The composition of matter of claim 1, wherein the copper-alloy particles further comprise:

oxygen in an amount of 0.008-0.015 wt %; and carbon in an amount of 0.008-0.020 wt %.

3. The composition of matter of claim 1, wherein the particles have a $D_{10}$ of 0.75 μm, a $D_{50}$ of 2.0 μm, and a $D_{90}$ of 3.5 μm.

4. The composition of matter of claim 3, wherein the copper-alloy particles further comprise:

oxygen in an amount of 0.008-0.015 wt %; and carbon in an amount of 0.008-0.020 wt %.

5. The composition of matter of claim 1, wherein the particles have a $D_{50}$ that is between 1.6-2.5 μm.

6. The composition of matter of claim 5, wherein the copper-alloy particles further comprise: oxygen in an amount of 0.008-0.015 wt %; and carbon in an amount of 0.008-0.020 wt %.

* * * * *